US005449868A

United States Patent [19]

Monson et al.

[11] Patent Number: 5,449,868

[45] Date of Patent: Sep. 12, 1995

[54] VACUUM BOTTLE CONTACTOR TIP PRESSURE ADJUSTER

[75] Inventors: Donald B. Monson, Eastover; Spaso Nocilo, Columbia, both of S.C.

[73] Assignee: Square D Company, Palatine, Ill.

[21] Appl. No.: 927,092

[22] Filed: Aug. 7, 1992

[51] Int. Cl.[6] ..... H01H 33/66

[52] U.S. Cl. ..... 218/118; 218/2

[58] Field of Search ... 200/144 B, 151, 144 R–144 AP

[56] References Cited

U.S. PATENT DOCUMENTS

| | | | |
|---|---|---|---|
| 3,655,930 | 4/1972 | Frey | 200/144 B |
| 3,958,156 | 5/1976 | Tjebben | 317/103 |
| 4,075,448 | 2/1978 | Seedorf et al. | 200/262 |
| 4,099,039 | 7/1978 | Barkan | 200/144 B |
| 4,449,021 | 5/1984 | Wakayama et al. | 200/144 B |

*Primary Examiner*—A. D. Pellinen
*Assistant Examiner*—Michael A. Friedhofer
*Attorney, Agent, or Firm*—Larry I. Golden; David R. Stacey; Larry T. Shrout

[57] ABSTRACT

The invention discloses a vacuum contactor assembly for controlling current flow in a single or multi-phase electrical circuit wherein each phase of the electrical circuit is controlled by a single vacuum interrupter. The stem pressure or pressure exerted on the electrical contacts of each vacuum interrupter during and after closing may be individually adjusted to an optimum operating pressure. The individual interrupter stem pressure adjustment is accomplished by placing a spring and an adjustment nut on the stem screw between the operating arm and the interrupter stem. By adjusting the free length of the spring with the adjusting nut, the interrupter stem pressure may be controlled.

4 Claims, 5 Drawing Sheets

VACUUM BOTTLE CONTACTOR TIP PRESSURE ADJUSTER

FIELD OF THE INVENTION

The present invention relates to electrical contactor assemblies and particularly to contactor assemblies having vacuum interrupters for controlling the electrical current flow in a circuit.

BACKGROUND OF THE INVENTION

It is common to employ vacuum contactors in power distribution systems for controlling current flow within a circuit. Each phase of a multi-phase circuit has one vacuum interrupter for controlling the current in that phase. All of the interrupters in the circuit are generally controlled by a single armature and coil. The interrupter stem or tip pressure is directly related to the force applied to the electrical contacts in the closed position and therefor critical to the operation of the interrupter. It will be understood by those skilled in the art that the terms, "stem pressure", "tip pressure", or "sealed pressure of contacts", as used herein, are synonymous and refer to the pressure between the contacts of a particular set of contacts of a vacuum interrupter when the contacts are in the closed position, and is usually measured in terms of the force in pounds exerted on the movable contact by the stem. If the stem pressure is too low, the contacts will close too fast causing them to bounce and produce an arc. The arc will erode the contact surface and may eventually cause welding of the contacts in the closed position. If the stem pressure is too high, the contacts will close too slowly or have insufficient pressure to maintain a good electrical connection. Slow closing of the contacts will prolong arcing and possibly cause welding of the contacts while a poor electrical connection can cause overheating and possible welding of the contacts. The amount of force applied to each interrupter stem is generally controlled by the tolerance of the parts used in the contactor assembly and the precision of the operator in assembling those parts. If the interrupter stem pressures in a multi-phase assembly are not within the specified tolerance range, a partial disassembly of the device and replacement of parts may be required to bring the stem pressures within tolerance. This is time consuming and greatly increases the manufacturing cost of the contactor assembly.

SUMMARY OF THE INVENTION

The present invention provides a means of adjusting the tip pressure of each vacuum interrupter separately, after the contactor has been completely assembled. The invention does not require that the parts of the assembly have a higher tolerance or that the assembly person be exceptionally skilled in aligning those parts during assembly. The invention provides a means for altering the force of an interrupter spring exerted on the interrupter stem thereby controlling the force applied to the contacts during and after closing. The optimum interrupter stem spring pressure can be determined empirically and is a function of the vacuum bottle construction, including the contacts disposed therein, and the geometry of the contactor assembly. In accordance with the present invention, an adjustment nut is provided for increasing or decreasing the compressed length of the interrupter spring, thereby adjusting the force exerted by the interrupter spring on the stem and accordingly the sealed pressure of the contacts.

Other features and advantages of the invention will become apparent to those skilled in the art upon review of the following detailed description, claims and drawings.

Figure 1:
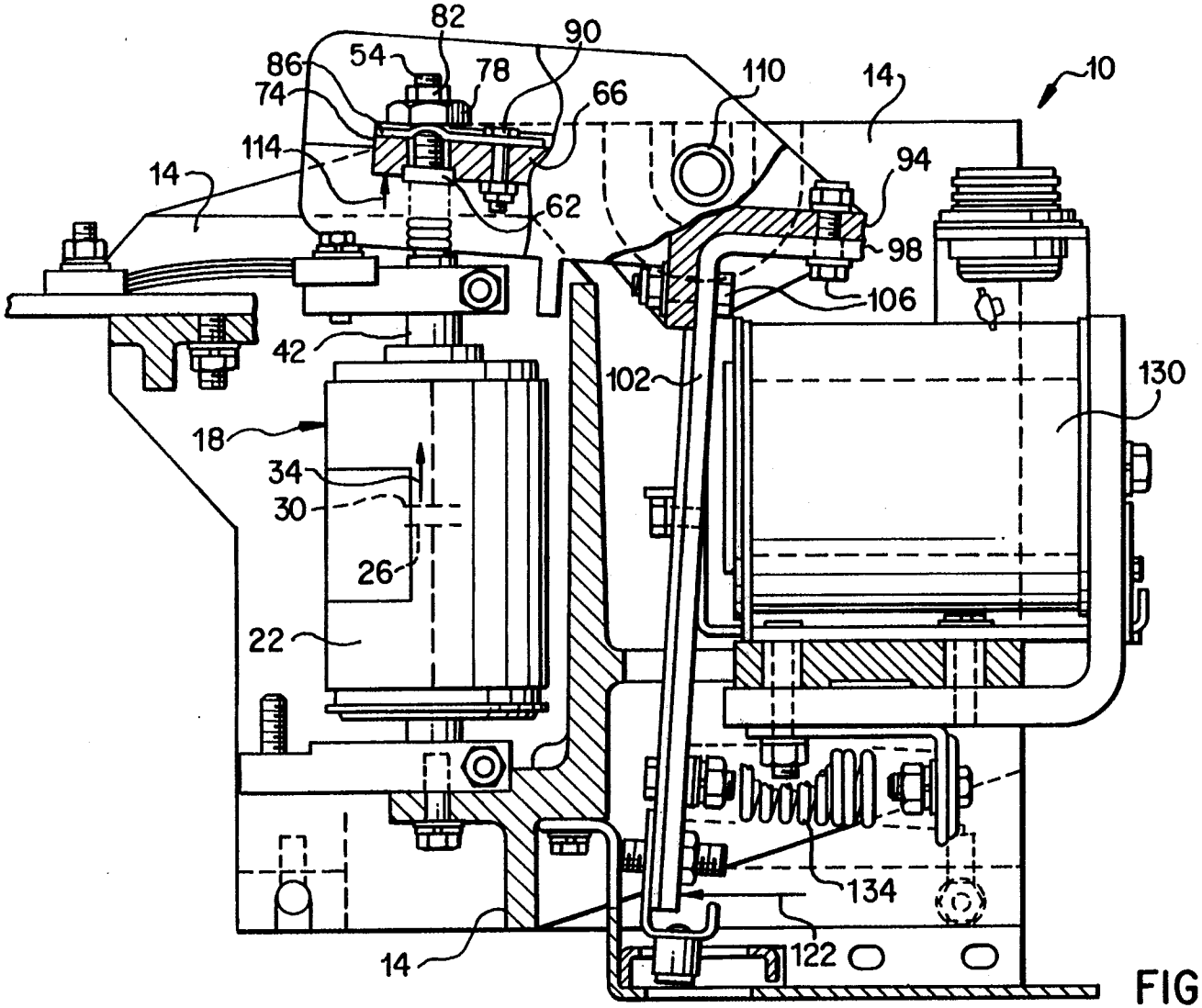
FIG. 1 PRIOR ART
FIG. 1 is a side view in partial cross-section of the prior art showing a contactor assembly with one vacuum interrupter (contacts shown in the open position).

Before one embodiment of the invention is explained in detail, it is to be understood that the invention is not limited in its application to the details of construction and description or illustrated in the drawings herein. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

A vacuum contactor assembly as generally indicated by reference number 10 is shown in FIG. 1. The assembly 10 includes a contactor frame 14 which provides support for the remaining components of the contactor assembly 10. A vacuum interrupter 18 such as the Westinghouse WL-35285 is provided for each electrical phase to be controlled by the contactor assembly 10.

Figure 2:
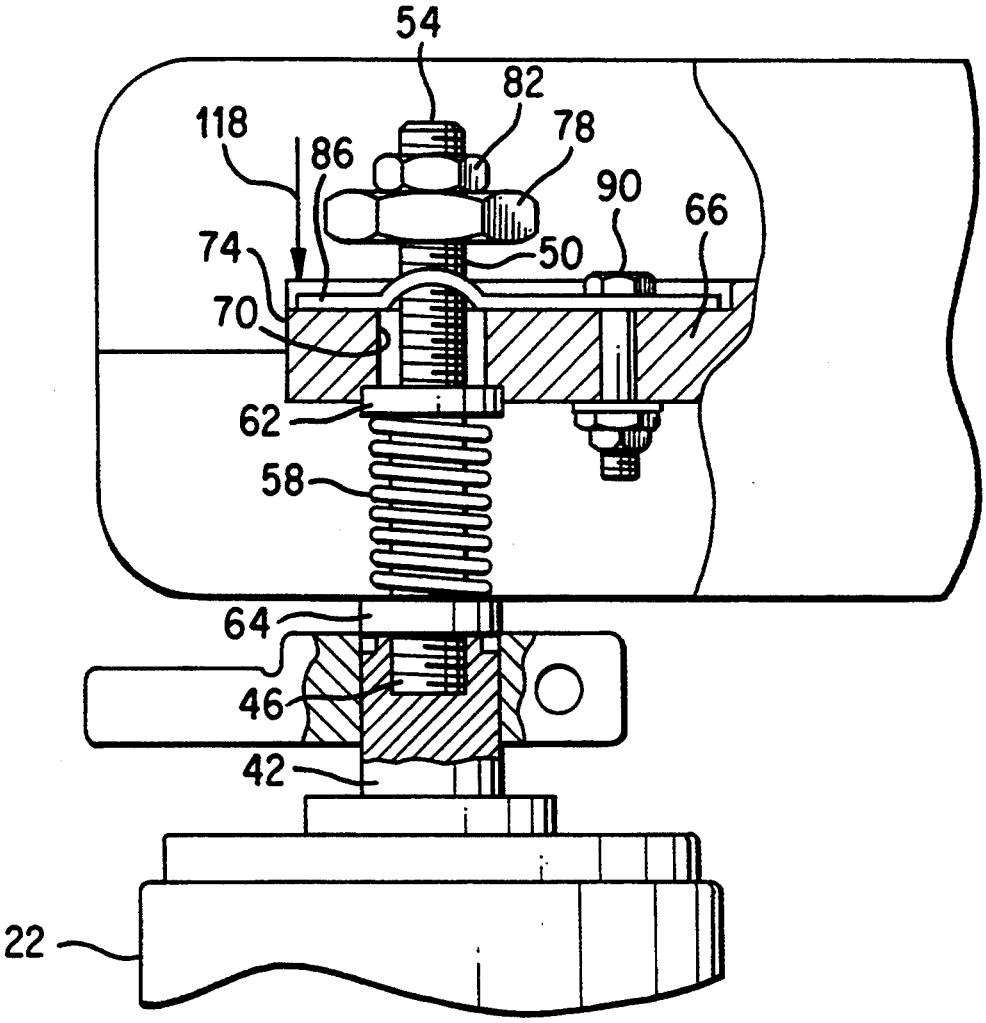
FIG. 2 PRIOR ART
FIG. 2 is a partial cross-section view of a prior art movable stem assembly for a vacuum interrupter (contacts shown in the closed position).
Figure 4:
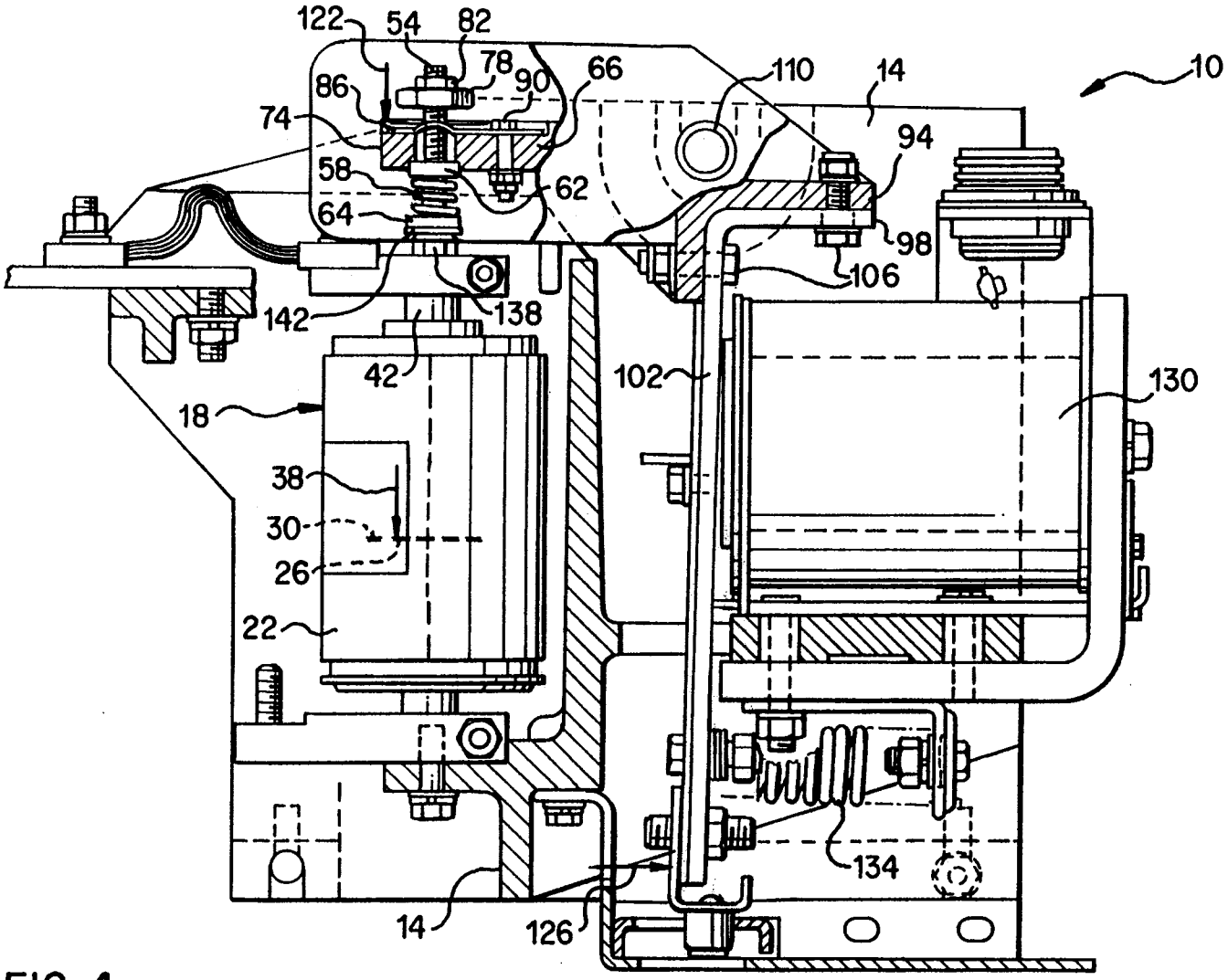
FIG. 4 is a side view in partial cross-section of a contactor assembly with one vacuum interrupter constructed in accordance with the present invention (contacts shown in the closed position).

Each interrupter 18 includes a vacuum bottle 22 which encloses a stationary electrical contact 26 and a movable electrical contact 30. The movable contact 30 is movable between an open position 34 and a closed position 38. In the open position 34, the movable contact 30 is spaced apart from the stationary contact 26 thereby prohibiting the flow of an electric current in the circuit. In the closed position 38, the movable contact 30 is in contact with the stationary contact 26 permitting an electric current to flow in the circuit. When the vacuum interrupter 18 is properly installed in the contactor assembly 10, the movable contact 30 will normally be biased to the open position 34. The movable contact 30 is connected to an external interrupter stem 42 such that they move together between the open position 34 (as shown in FIG. 1) and the closed position 38 (as shown in FIG. 4). The interrupter stem 42 passes through a bellows-like seal (not shown) in one end of the vacuum bottle 22. The bellows-like seal permits the interrupter stem 42 to move the movable contact 30 in response to an external force applied to the interrupter stem 42 without loosing the vacuum within the vacuum bottle 22. Referring to FIG. 2, the external end of the interrupter stem 42 is threaded to receive a first end 46 of a stem screw 50. The stem screw 50 extends outward from the interrupter stem 42 ending at a distal end 54. A stem spring 58 is placed about the stem screw 50 between an upper and lower spring cup 62 and 64, respectively.

The stem screw 50 is connected to an arm 66 by inserting the distal end 54 of the stem screw 50 through a clearance hole 70 in a first end 74 of the arm 66. The stem screw 50 is retained in the hole 70 by a nut 78 and a lock nut 82 placed on its distal end 54. A pivot plate 86 is placed between the nut 78 and the arm 66. The pivot plate 86 is attached to the arm 66 by a screw and nut 90.

A second end 94 of the arm 66 is connected to a first end 98 of an armature 102 by nuts and bolts 106. The arm 66 is also pivotally connected to a shaft 110 near the second end 94 such that the first end 74 may pivot between a first position 114 and a second position 118 in response to movement of the armature 102 between a first position 122 and a second position 126 as shown in FIG 4. The first positions 114 and 122 are associated with the open position 34 of the movable contact 30 and the second positions 118 and 126 are associated with the closed position 38 of the movable contact 30. The pivot plate 86 on the arm 66 allows the stem screw 50 to remain in proper alignment with the vacuum bottle 22 as first end 74 of arm 66 pivots between its first and second positions 114 and 118, respectively.

The armature 102 is moved between its first and second positions 122 and 126, respectively, by an electromagnetic coil 130 and an armature spring 134. The armature spring 134 biases the armature 102 to its first position 122 wherein the armature 102 is spaced apart slightly from the coil 130. In this first position 122, the first end 74 of the arm 66 is in its first position 114 and pulls outwardly against nut 78, and consequently stem screw 50 and interrupter stem 42 causing movable contact 30 to be in the open position 34. When an electric current is applied to the coil 130 a magnetic field is set up. This magnetic field overcomes the force of armature spring 134 and pulls the nature 102 from its first position 122 to its second position 126. As the armature 102 moves from its first position 122 to its second position 126, the first end 74 of arm 66 also moves from its first position 114 to its second position 118. In the second position 118, the first end 74 of the arm 66 presses against the upper spring cup 62 thereby forcing stem screw 50 and interrupter stem 42 downward, moving the movable contact 30 into the closed position 38.

A vacuum contactor as described above and shown in FIG. 1 and 2 represents the prior art. There is no provision in prior art vacuum contactors for adjusting the length of stem spring 58 after assembly of the contactor and thereby controlling the interrupter stem pressure.

Figure 3:
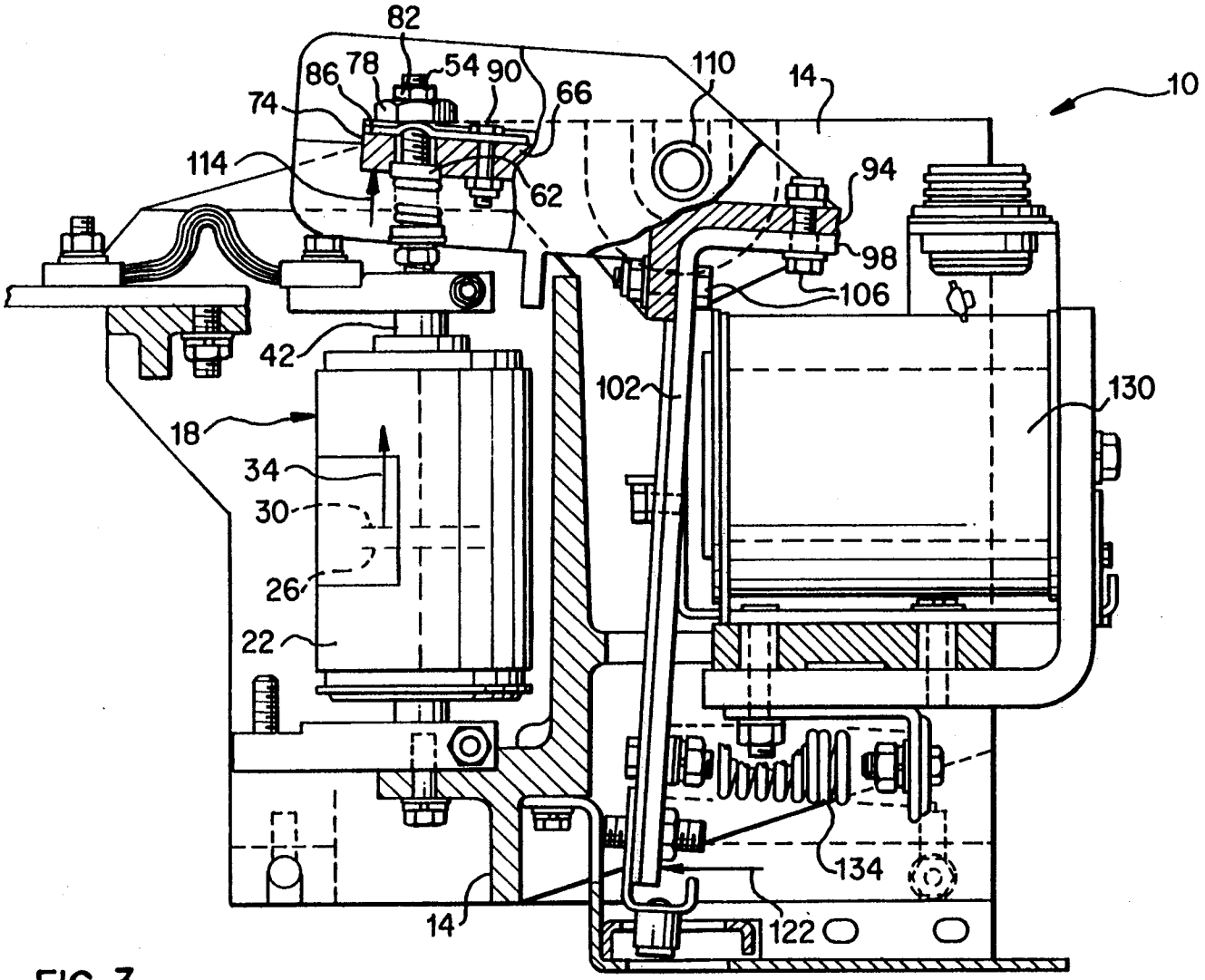
FIG. 3 is a side view in partial cross-section of a contactor assembly with one vacuum interrupter constructed in accordance with the present invention (contacts shown in the open position).
Figure 5:
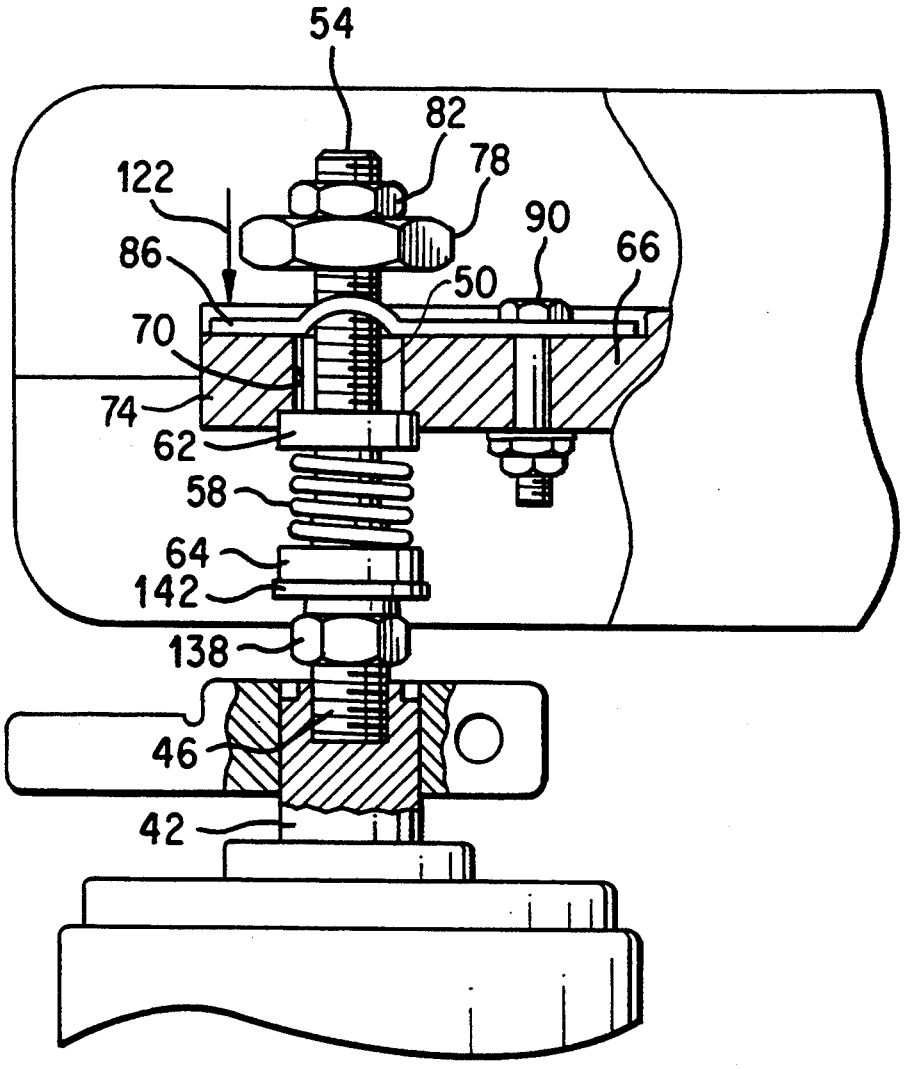
FIG. 5 is a partial cross-sectional view of an adjustable stem assembly for a vacuum interrupter constructed in accordance with the present invention (contacts shown in the closed position).

The present invention as shown In FIGS. 3–5 consists of all of the elements described above in the prior art, and additionally includes a stem spring adjusting nut 138 and a bearing washer 142. The stem spring adjusting nut 138 and the bearing washer 142 are placed on the stem screw 50 between the lower spring cup 64 and the interrupter stem 42. The bearing washer 142 Is placed immediately below the lower spring cup 64 and immediately above the adjusting nut 138. The bearing washer 142 serves as bearing surface between the lower spring cup 64 and the adjusting nut 138.

To adjust the interrupter stem pressure, a test fixture (not shown) is placed on the contactor frame 14 above the interrupter 18. The test fixture includes a force gauge attached to a threaded crank which is received In a threaded hole in the test fixture. As the crank is turned, the force gauge will move vertically up and down in relation to the test fixture. The indicator means of the force gauge is provided with a means for connecting to the distal end 54 of the stem screw 50 such that when the crank is turned the force gauge will display the force applied between the contactor frame 14 and the stem screw 50. The coil 130 is energized thereby holding the contacts 26 and 30 in the closed position 38 while the crank is turned in a direction that will cause the movable contact 30 to move to the open position 34. When the movable contact 30 has reached the open position 34, the stem spring 58 will be adjusted to the predetermined optimum stem pressure by moving the adjusting nut 138 up or down as required on the stem screw 50 until the optimum pressure is shown on the test fixture force gauge. The up or down movement of the adjusting nut 138 on the stem screw 50 alters the free length of the stem spring 58.

We claim:

1. An improved vacuum interrupter assembly of the type having a vacuum bottle containing a stationary electrical contact, a movable electrical contact movable between a contact open position and a contact closed position, a bellows-like seal in one end of the vacuum bottle, an interrupter stem connected to the movable contact and passing through the bellows-like seal and being movable with respect to the vacuum bottle such that the movable contact may be moved between the open and closed contact positions by an external means, a stem screw threaded into an external end of the interrupter stem, a stem spring for exerting a force on said stem, said spring positioned concentrically about the stem screw and between an upper and a lower spring cup, a pivotal arm having a first end resting on the upper spring cup and a clearance hole for loosely receiving the stem screw and a second end connected to an armature, a nut placed on the stem screw for retaining it to the first end of the arm, means for moving the armature from a first position corresponding to the open contact position to a second position corresponding to the closed contact position; the improvement comprising:

means for adjusting to a predetermined optimum value, without disassembly of said vacuum interrupter assembly, the force exerted by said stem spring on said stem when the contacts are in the closed position, said means for adjusting is set after the vacuum interrupter has been fully assembled thereby eliminating manufacturing tolerances inherent to a mechanical mechanism.

2. The improved vacuum interrupter assembly of claim 1, the improvement further comprising said means for adjusting the force exerted by the stem spring comprising means for adjusting the compressed length of said spring when said contacts are in the closed position.

3. The improved vacuum interrupter assembly of claim 2, the improvement further comprising said means for adjusting the compressed length of said stem spring comprising:

a) an adjusting nut placed on the stem screw between the interrupter stem and the lower spring cup for adjusting the free length of the stem spring; and b) a bearing washer placed between said adjusting nut and the lower spring cup to provide a bearing surface between said adjusting nut and the lower spring cup.

4. An improved vacuum interrupter assembly comprising in combination:

a contactor assembly frame a vacuum bottle assembly rigidly attached to the contactor frame assembly including a vacuum and containing a stationary electrical contact, a movable electrical contact movable between a contact open position and a contact closed position, a bellows-like seal in one end of the vacuum bottle, an interrupter stem connected to the movable contact inside the vacuum bottle and passing through the bellows-like seal such that it has an external end, the interrupter stem is movable with respect to the vacuum bottle such that the movable contact may be moved between the contact open and contact closed positions;

a stem screw threaded into the external end of the interrupter stem;

an upper spring cup installed on the stem screw;

a lower spring cup installed on the stem screw;

a stem spring positioned concentrically about the stem screw and between the upper and lower spring cups;

an arm pivotally attached to the contactor frame assembly such that it is movable between a first position and a second position, the arm having a first end which includes a clearance hole for loosely receiving the stem screw and a second end, the first end being in contact with the upper spring cup such that movement of the arm from the first position to the second position causes the movable contact to move from the contact open to the contact closed position as the stem spring is compressed;

a retaining nut for retaining said stem screw within the clearance hole of the first end of the arm;

a locking nut for preventing the retaining nut from turning on the stem screw;

an armature attached to the second end of the arm such that movement of the armature is transmitted to the arm;

means for electromagnetically moving the armature from a first position corresponding to the open contact position to a second position corresponding to the closed contact position;

an adjusting nut threadably received on the stem screw at a point below the lower spring cup, said adjusting nut for adjusting to a predetermined optimum value the pressure applied to the interrupter stem by the arm through the stem spring when the arm is in its second position, said adjusting nut is set after the vacuum interrupter has been fully assembled thereby eliminating manufacturing tolerances inherent to a mechanical mechanism; and a bearing washer placed between the lower spring cup and said adjusting nut for providing a smooth bearing surface between the adjusting nut and the lower spring cup as the adjusting nut is rotated.

* * * * *